United States Patent [19]

Hufendiek

[11] 4,112,897

[45] Sep. 12, 1978

[54] ROTATIONAL SPEED GOVERNOR FOR AN INJECTION PUMP IN AIR-COMPRESSING INJECTION INTERNAL COMBUSTION ENGINES

[75] Inventor: Ernst-Wilhelm Hufendiek, Stuttgart, Fed. Rep. of Germany

[73] Assignee: Daimler-Benz Aktiengesellschaft, Fed. Rep. of Germany

[21] Appl. No.: 743,980

[22] Filed: Nov. 22, 1976

[30] Foreign Application Priority Data

Nov. 26, 1975 [DE] Fed. Rep. of Germany ..... 2552991

[51] Int. Cl.[2] ..... F02M 39/00; F02D 1/02; F02N 17/00

[52] U.S. Cl. ..... 123/139 ST; 123/140 R; 123/140 MC; 123/179 G

[58] Field of Search ..... 123/139 ST, 140 R, 140 MC, 123/179 G, 179 L, 180 T

[56] References Cited

U.S. PATENT DOCUMENTS

| | | | |
|---|---|---|---|
| 2,619,080 | 11/1952 | Weber | 123/139 ST |
| 3,638,631 | 2/1972 | Eheim | 123/139 ST |
| 3,814,072 | 6/1974 | Gillespie | 123/179 G |
| 3,835,828 | 9/1974 | Knapp | 123/179 G |
| 3,923,026 | 12/1975 | Aoki | 123/140 R |
| 3,924,594 | 12/1975 | Aoki | 123/140 MC |
| 3,974,814 | 8/1976 | Eheim | 123/140 R |

FOREIGN PATENT DOCUMENTS

| | | | |
|---|---|---|---|
| 1,093,141 | 11/1960 | Fed. Rep. of Germany | 123/139 ST |
| 337,177 | 11/1929 | United Kingdom | 123/139 ST |

*Primary Examiner*—Charles J. Myhre
*Assistant Examiner*—Parshotam S. Lall
*Attorney, Agent, or Firm*—Craig & Antonelli

[57] ABSTRACT

A rotational speed controller for an injection pump in air-compressing injection internal combustion engines with an abutment member limiting the full-load injection quantity by way of the control rack of the injection pump; during the starting operation of the internal combustion engine, the abutment member releases the travel of the control rack in the direction of the starting quantity while a temperature-dependent control member directly cooperating with the abutment is provided, which above a predetermined temperature cancels the release of the starting quantity.

11 Claims, 2 Drawing Figures

Figure 1:
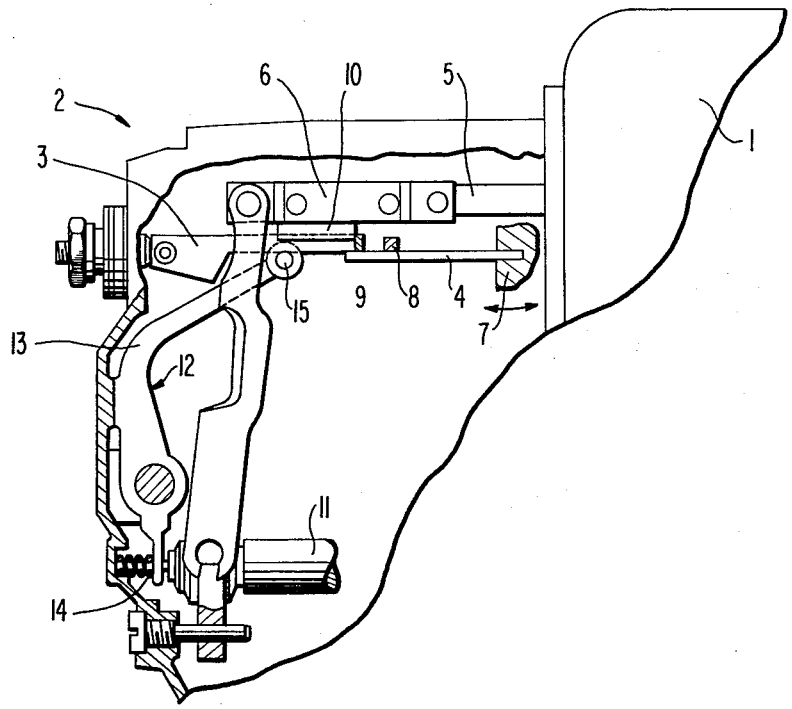

ROTATIONAL SPEED GOVERNOR FOR AN INJECTION PUMP IN AIR-COMPRESSING INJECTION INTERNAL COMBUSTION ENGINES

The present invention relates to a rotational speed controller for an injection pump in air-compressing injection internal combustion engines with an abutment member limiting the full-load injection quantity by way of the control rack of the injection pump, which during the starting operation of the internal combustion engine frees the travel or releases the path of the control rack in the direction of the starting quantity.

In order to be able to reliably start air-compressing injection internal combustion engines in cold weather, more fuel is injected during the starting operation than with an internal combustion engine operated at full load.

However, a considerable black smoke or a so-called starting smoke-puff is produced by the increased injection quantity which at predetermined warmed-up temperatures of the internal combustion engine causes an unnecessary environmental soiling.

In order to counteract this disadvantage, an abutment installation has already been proposed according to the German Gebrauchsmuster No. 1,853,853 which with a warmed-up internal combustion engine permits a lesser feed quantity for purposes of starting than with a cold internal combustion engine.

The abutment installation of this prior art proposal essentially consists of spirally-shaped, wound bimetallic elements and of a rotatable abutment member dependent in its rotary movement on the rotary position of this bimetallic member and connected with the control rack of the injection pump, which abutment member includes two abutment surfaces, of which one determines the starting quantity and the other the full-load injection quantity.

The construction of this prior art installation, however, is structurally very costly and space-consuming. Therebeyond, an injection is possible in the driving operation after the cold start which again corresponds to the starting quantity. Only with a warm internal combustion engine the full load injection quantity is limited by a corresponding rotation of the abutment member.

The present invention is concerned with the task to undertake simple and space-saving measures from a constructive point of view which additionally prevent a smoke development during the starting operation as well as an injection during the driving operation after the cold-starting of the engine which corresponds to the starting quantity.

The underlying problems are solved according to the present invention in that the rotational speed controller or governor is provided with a temperature-dependent control member cooperating directly with the abutment member, which control member cancels the release of the starting quantity above a predetermined temperature.

Since air-compressing injection internal combustion engines require the starting quantity only at operating temperatures below 0° C., it suffices for the prevention of the black smoke, to inject above 0° C. operating temperatures only the full-load injection quantity during the starting operation.

In a preferred embodiment, the control member may consist of a strip-shaped bimetallic element which is fixedly clamped-in at one side thereof in the rotational speed controller.

In order not to impair the functioning ability of the temperature-dependent starting quantity release in an internal combustion engine with a charging pressure and/or atmospheric pressure-dependent controller or governor adapted to influence the full-load injection quantity in the direction toward an increased or reduced quantity, provision is additionally made according to the present invention that the bimetallic element abuts above a predetermined temperature of the internal combustion engine, for example, at 0° C., at a stop arranged in the rotational speed controller or governor in such a manner that the abutment member slides freely displaceably on the bimetallic element.

Due to the costly type of construction, a matching of the full-load injection quantity to the charging-pressure or atmospheric-pressure is possible in the prior art installation according to the Gebrauchsmuster No. 1,853,853 only in a complicated manner since many structural changes are required.

Accordingly, it is an object of the present invention to provide a rotational speed controller for an injection pump in air-compressing injection internal combustion engines which avoids by simple means the aforementioned shortcomings and drawbacks encountered in the prior art.

Another object of the present invention resides in a rotational speed governor for an injection pump in air-compressing injection internal combustion engines which minimizes the production of black smoke during the starting of the engine.

A further object of the present invention resides in a rotational speed controller for an injection pump of an internal combustion engine which is relatively space-saving and low in cost as regards the structure involved.

Another object of the present invention resides in a rotational speed controller for an injection pump of an internal combustion engine which reliably precludes the injection of a quantity of fuel during the driving operation of the engine that corresponds again to the cold-start injection quantity.

Still a further object of the present invention resides in a governor for injection pumps of internal combustion engines which is not only simple in construction but permits its use by simple means for a control of the full-load injection quantity as a function of charging and/or atmospheric pressure.

Figure 2:
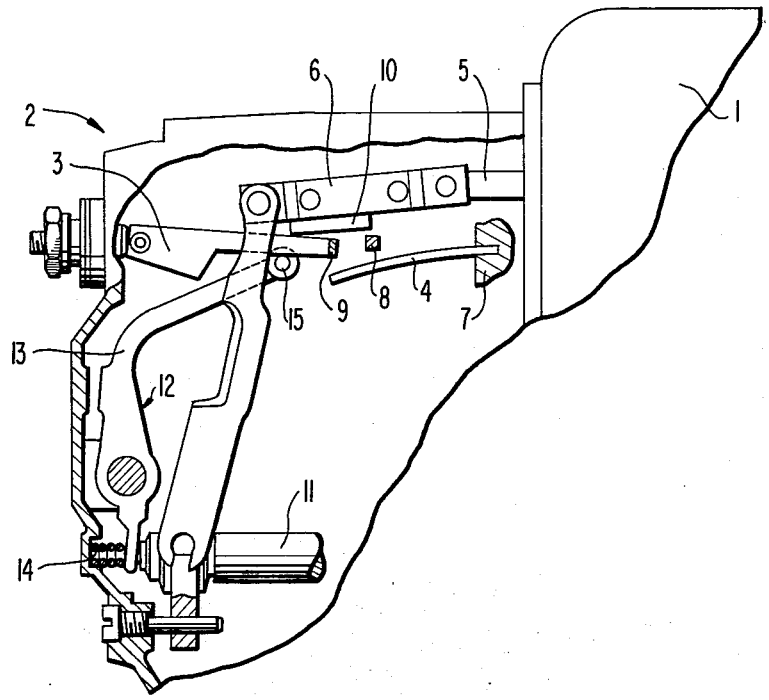

These and other objects, features and advantages of the present invention will become more apparent from the following description when taken in connection with the accompanying drawing which shows, for purposes of illustration only, one embodiment in accordance with the present invention, and wherein:

FIG. 1 is a cross-sectional view through a rotational speed controller in accordance with the present invention, shown only partly, whose abutment member limits the full-load injection quantity; and FIG. 2 is a cross-sectional view through the rotational speed controller according to FIG. 1, in which the abutment member releases the starting quantity.

Referring now to the drawing wherein like reference numerals are used throughout the two views to designate like parts, a rotational speed controller or governor 2 for air-compressing injection internal combustion engines, which is secured at the end face of an injection pump 1, is provided with a pivotally supported abutment member 3 which directly cooperates with a temperature-dependent control member 4, for instance, with a strip-shaped bimetallic element 4 constructed as leaf spring, and which, dependent on the temperature of the internal combustion engine, either limits the full-load injection quantity or releases the starting quantity by way of a pivotal fork-like member 6 connected with the control rack 5 of the injection pump 1.

The leaf-spring 4, whose one-sided mounting support can be adjusted by means of a conventional mechanism 7, indicated only schematically in the drawing, abuts at temperatures of the internal combustion engine above 0° C. with its free end at a fixed stop 8, whereby at the same time the abutment member 3 slidingly rests with its nose portion 9 on the end portion of the leaf spring 4, as shown in FIG. 1. The stop 8 prevents the leaf spring 4 from deflecting too far in the upward direction and, the nose portion 9 of the abutment member 3 causing undesirable friction.

A stop part 10 projecting downwardly from the pivotal fork-like member 6 abuts at the nose portion 9 so that in this manner the full-load position of the control rack 5 is determined. The injection of the starting quantity is therewith precluded.

When turning off the internal combustion engine, an adjusting bolt 11 of a flyweight mechanism (not shown) presses a rocker lever 12 with its arm 13 downwardly against the force of a prestressed spring 14 by rotation in the clockwise direction. This position of the rocking lever 12 and of the adjusting bolt 11 is illustrated in FIG. 2. The abutment member 3 which otherwise deflects downwardly as a result of its own weight or of a spring force and which releases the starting quantity, however, is stopped in the pivot direction by the warm leaf spring 4.

If with a still warm internal combustion engine a new starting now takes place, then the control rack 5 can be adjusted only to full-load injection quantity and not to the starting quantity. The starting smoke puff is thus prevented.

In FIG. 2, the control rack 5 is illustrated with the internal combustion engine at standstill at a temperature $< 0°$ C. The cold leaf spring 4 is deflected downwardly and releases the pivot range of the abutment member 3, which in the illustrated position is supported on the bolt 15 of the arm 13 of the rocking lever 12. As a result of actuation of the regulating lever (not shown) the control rack 5 can be adjusted to the starting quantity and thus permits a starting of the internal combustion engine at temperatures below 0° C.

Immediately after the starting of the internal combustion engine, the adjusting bolt 11 lifts off from the rocking lever 12, and the spring presses the abutment member 3 into the position illustrated in FIG. 1 by way of a bolt 15 of this rocking lever 12.

With a renewed actuation of the control lever, the control rack 5 can be adjusted maximum to a full-load injection quantity. The starting quantity is blocked.

The mounting support of the leaf spring 4 can be rotated by an installation, for example, by a worm gear arrangement, in the directions indicated in FIG. 1 by the double arrows in order to be able to adjust therewith temperatures, beginning with which the starting quantity is released.

The described temperature-dependent starting-quantity release is applicable to different types of rotational speed controllers or governors both in conjunction with a charge-pressure-dependent full-load abutment as also in conjunction with an atmospheric pressure-dependent full-load abutment.

In addition, a driving operation with the starting quantity (a so-called manner of trick-driving) is not possible with a warm internal combustion engine as a result of the arrangement according to the present invention.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A rotational speed controller for an injection pump with an abutment means for controlling the injection quantity by interacting with a control rack of the injection pump, which abutment means releases the travel of the control rack in the direction toward a starting quantity, which is increased relative to a post warm-up fuel quantity, during the starting operation of an internal combustion engine, characterized in that an engine temperature-dependent control means is provided which cooperates with said abutment means and which is operable to cancel the release of the increased starting quantity above a predetermined temperature.

2. A rotational speed controller according to claim 1, characterized in that said control means cooperates directly with the abutment means.

3. A rotational speed controller according to claim 1, characterized in that the internal combustion engine is an air-compressing injection internal combustion engine.

4. A rotational speed controller according to claim 2, characterized in that said control means includes a bimetallic element which is mounted on one side in the rotational speed controller.

5. A rotational speed controller according to claim 4, characterized in that the bimetallic element is strip-shaped and the said one side of the bimetallic element is adjustably mounted in the controller.

6. A rotational speed controller according to claim 4, with means operable to influence the full-load injection quantity in the direction of an increased or decreased quantity as a function of at least one of charging pressure and atmospheric pressure, characterized in that the bimetallic element of the control means so abuts at a fixed stop arranged in the rotational speed controller above the predetermined temperature of the internal combustion engine that the abutment means slides substantially freely displaceably on the bimetallic element of the control means.

7. A rotational speed controller according to claim 6, characterized in that said predetermined temperature is about 0° C.

8. A rotational speed controller according to claim 7, characterized in that said abutment means is a pivotally mounted abutment member operable to engage directly with its free end the free end of the bimetallic element of the control means.

9. A rotational speed controller according to claim 1, with means operable to influence the full-load injection quantity in the direction of an increased or decreased quantity as a function of at least one of charging pressure and atmospheric pressure, characterized in that the control means so abuts at a fixed stop arranged in the rotational speed controller above the predetermined temperature of the internal combustion engine that the abutment means slides substantially freely displaceably on the control means.

10. A rotational speed controller according to claim 9, characterized in that said abutment means is a pivotally mounted abutment member operable to engage directly with its free end the free end of the control means.

11. A rotational speed controller for an injection pump having a control rack comprising:

abutment means for displacing said control rack in a direction increasing the amount of fuel supplied by said injection pump relative to a post warm-up quantity, and engine temperature responsive means positioned so as to be cooperable with said abutment means for decreasing the amount of fuel supplied by the injection pump to said post warm-up quantity in dependence upon the engine reaching a predetermined temperature.

* * * * *